US005133407A

United States Patent [19]

Deines et al.

[11] Patent Number: 5,133,407

[45] Date of Patent: Jul. 28, 1992

[54] FLUID INJECTION AND PRODUCTION APPARATUS AND METHOD

[75] Inventors: Timothy A. Deines; David E. Ellwood, both of Midland, Tex.

[73] Assignee: Marathon Oil Company, Findlay, Ohio

[21] Appl. No.: 705,464

[22] Filed: May 24, 1991

[51] Int. Cl.[5] ..... E21B 43/00

[52] U.S. Cl. ..... 166/267

[58] Field of Search ..... 166/264–269

[56] References Cited

U.S. PATENT DOCUMENTS

| | | | |
|---|---|---|---|
| 1,674,815 | 6/1928 | Barnhart | 166/265 X |
| 1,820,291 | 8/1931 | Strandell | 166/265 X |
| 1,886,886 | 11/1932 | Kelley et al. | 166/265 |
| 4,112,745 | 9/1978 | McCabe et al. | 166/266 X |

*Primary Examiner*—Thuy M. Bui

*Attorney, Agent, or Firm*—Jack L. Hummel; Jack E. Ebel

[57] ABSTRACT

An apparatus and method for injecting fluid into and producing fluid, including gas, from a subterranean formation via a well in fluid communication with the formation. Fluid is injected into the subterranean formation through a first generally tubular conduit in the well and fluid is produced from formation to the surface through this conduit until fluid flow ceases. Thereafter, fluid is pumped from the formation into the tubular conduit and diverted into the annulus defined between the conduit and the well. The pressure drop created by this diversion causes gas to break out of the produced fluid. The remaining fluid is diverted back into the conduit and pumped to the surface while the gas is produced to the surface via the annulus.

23 Claims, 5 Drawing Sheets

FLUID INJECTION AND PRODUCTION APPARATUS AND METHOD

BACKGROUND OF INVENTION

1. Technical Field

The present invention relates to an apparatus and method for injecting fluid into and producing fluid from a subterranean formation via a well in fluid communication with the formation, and more particularly, to an apparatus and method for injecting a gas into a subterranean formation via a well in fluid communication therewith and for producing both gas and liquid from the formation via the well.

2. Description of Related Art

Liquid hydrocarbons present in a subterranean hydrocarbon-bearing formation are conventionally produced to the surface of the earth via a well penetrating and in fluid communication with the formation. Approximately 20 to 30 percent of the volume of liquid hydrocarbons originally present within a given subterranean formation can be produced by the natural pressure of the formation, i.e., by primary production. Accordingly, secondary and tertiary recovery processes have been developed to recover additional incremental amounts of liquid hydrocarbons originally present in the subterranean formation. One such secondary and/or tertiary recovery operation is a cyclic injection/production process. This process, sometimes referred to as "huff-n-puff", involves injecting a fluid via a single well into a subterranean hydrocarbon-bearing formation so as to contact hydrocarbons in place in the near-well bore environment of the subterranean formation surrounding the well. The well may then be "shut in" for a period of time. After the shut-in period, the well is returned to production wherein an incremental volume of liquid hydrocarbons is produced from the formation to the surface via the same well. Carbon dioxide, natural gas, flue gas, and steam have been used or proposed for use in cyclic injection/production processes.

A well penetrating and in fluid communication with a subterranean hydrocarbon-bearing formation is normally provided with casing which is cemented to the walls of the well bore and is perforated to provide fluid communication with a subterranean formation of interest. A fluid is conventionally injected into the formation via such a well by first lowering a tubing string through the cased well bore to a position juxtaposed the perforated interval of the well bore. A packer which is secured to the tubing string is then expanded into contact with the casing so as to isolate the annulus defined between the casing and tubing string from the perforated interval of casing. A fluid is then injected via the tubing string, through the perforated interval of casing, and into the subterranean hydrocarbon-bearing formation. After a suitable soak period, if any, both the fluid injected into the formation and hydrocarbons originally present in the formation are produced via the tubing string to the surface. However, once the well ceases to flow from the pressure created by the injection of the treatment fluid into the subterranean formation, an artificial lift must be installed within the well to produce fluid therefrom. Thus, a kill fluid, for example, brine or produced water, is introduced into the annulus defined between the casing and the tubing string as the packer on the tubing string is deflated. The kill fluid balances the hydrostatic formation pressure and thereby prevents fluid from the subterranean hydrocarbon-bearing formation from entering the well and flowing to the surface. The tubing string is then removed from the well and a different tubing string which is configured to permit fluids to be produced from the well by means of a reciprocating rod pump is positioned within the well. This production tubing string may not include an expandable packer for isolating the casing/tubing annulus. A conventional reciprocating rod pump which is utilized in a well normally contains two valves. One valve is termed the traveling valve and is attached to the pump plunger while the other valve is a standing valve and is positioned within the tubing. The action of the plunger going up causes a reduction in pressure in the pump chamber which permits the standing valve to open.

One problem associated with the conventional technique for injecting and producing fluids from one well is that kill fluid invades the treated area of the subterranean formation and/or contaminates the treatment fluid previously injected into the subterranean formation thereby reducing the effectiveness of the treatment. In wells that produce fluid from a subterranean formation which contains a significant quantity of entrained or dissolved gas, the gas, including the treatment gas and/or gas, such as hydrogen sulfide or methane, originally present in the formation, will break out of solution as the pump plunger is lifted upwardly. Once out of solution, this gas will compress thereby preventing the traveling valve from opening. Thus, the pump becomes inoperable due to gas locking or gas interference. A procedure termed "tagging bottom" has been employed to unseat a traveling valve in a gas locked pump. In accordance with this procedure, the sucker rod string is lowered within a well a sufficient distance to allow the pump to physically contact the bottom of the tubing string with sufficient force to unseat the traveling valve. Thereafter the rod string is raised to reposition the pump adjacent the perforated interval.

Another problem in utilizing a reciprocating rod pump to produce fluids from a cased well bore occurs when a packer is employed to isolate the annulus between the casing and tubing. When entrained or dissolved gas is produced via perforations into a cased well bore, the pressure drop which occurs as the fluid is produced into the well bore permits the gas to break out of the produced fluid and collect under a packer. As sufficient gas pressure builds up underneath the packer, the fluid level will be depressed to a level below the pump intake thereby preventing fluid from being produced from the well bore. Thus, a need exists for an apparatus which can be used to inject fluid into and produce fluid from a subterranean hydrocarbon-bearing formation without the use of a kill fluid and without the problems associated with gas breaking out of produced fluid.

Accordingly, it is an object of the present invention to provide an apparatus for both injecting fluid into and producing fluid from a subterranean formation.

It is another object to provide a method and apparatus for injecting fluid into producing fluid from a subterranean formation which eliminates the use of a kill fluid.

It is a further object of the present invention to provide an apparatus and method for producing fluids including entrained or dissolved gas from a subterranean formation which substantially eliminates the possibility of reciprocating pump malfunction due to gas locking or interference.

It is a still further object of the present invention to provide an apparatus and method for producing fluids including entrained or dissolved gas from a subterranean formation which substantially eliminates fluid production problems associated with gas breaking out of fluid produced from the formation.

It is also an object of the present invention to provide an apparatus for injecting fluid into and producing fluid from a subterranean formation which is relatively simple in construction and can be readily assembled and disassembled at the well site to facilitate use and maintenance thereof.

SUMMARY OF INVENTION

To achieve the foregoing and other objects, and in accordance with the purposes of the present invention, as embodied and broadly described herein, one characterization of the present invention comprises an apparatus for transporting fluid. The apparatus has three generally tubular assemblies. A first generally tubular assembly has a first end and a second end and at least one aperture therethrough. A second generally tubular assembly has a first end and a second end and is positioned within said first tubular assembly. The second end of the first assembly is secured to the second end of the second assembly. A first means is provided for selectively permitting fluid flow between the exterior and the interior of the second assembly. A third generally tubular assembly has a first end and a second end. The first end of the third assembly is secured to the second end of the first assembly. A second means is provided for selectively permitting fluid flow between the exterior and the interior of the third assembly.

In another characterization of the present invention, an apparatus is provided for injecting fluid into and producing fluid from a subterranean formation via a well in fluid communication with the formation. The apparatus comprises a tubing string, a fluid transporting apparatus and means for sealing the annulus defined between the fluid transporting apparatus and the well. The tubing string extends from a well head at an earthen surface into the well and terminates in a first end. A fluid transporting apparatus is positioned within the well and is secured to the first end of said tubing string. The fluid transporting apparatus comprises a first generally tubular assembly having a first end and a second end. The first assembly has at least one aperture therethrough. A second generally tubular assembly has a first end and a second end and is positioned within the first elongated tubular assembly. The second end of the first assembly is secured to second end of the second assembly. A first means is provided for selectively permitting fluid flow between the exterior and the interior of said second assembly. A third generally tubular assembly has a first end and a second end. The first end of the third assembly is secured to the second end of the first assembly. A second means is provided for selectively permitting fluid flow between the exterior and interior of the third assembly.

In yet another characterization of the present invention, a method is provided for injecting fluid into and producing fluid from a subterranean formation via a well in fluid communication with the formation. The method comprises injecting fluid from an earthen surface through a first generally tubular conduit positioned within the well and into the formation and producing fluid from the formation into the well and through the first generally tubular conduit to the surface until the fluid ceases to flow. Thereafter, fluid is pumped from the formation and into the tubular conduit. Pumped fluid is diverted from the tubular conduit into an annulus defined between the tubular conduit and the well. The step of diverting creates a pressure drop sufficient to permit the fluid to separate into gas and liquid. Gas is produced to the surface via the annulus while liquid is diverted into and produced to the surface via the tubular member.

BRIEF DESCRIPTION OF THE DRAWINGS

The accompanying drawings, which are incorporated in and form a part of the specification, illustrate the embodiments of the present invention and, together with the description, serve to explain the principles of the invention, in the drawings.

DETAILED DESCRIPTION OF THE PREFERRED EMBODIMENTS

Figure 1:
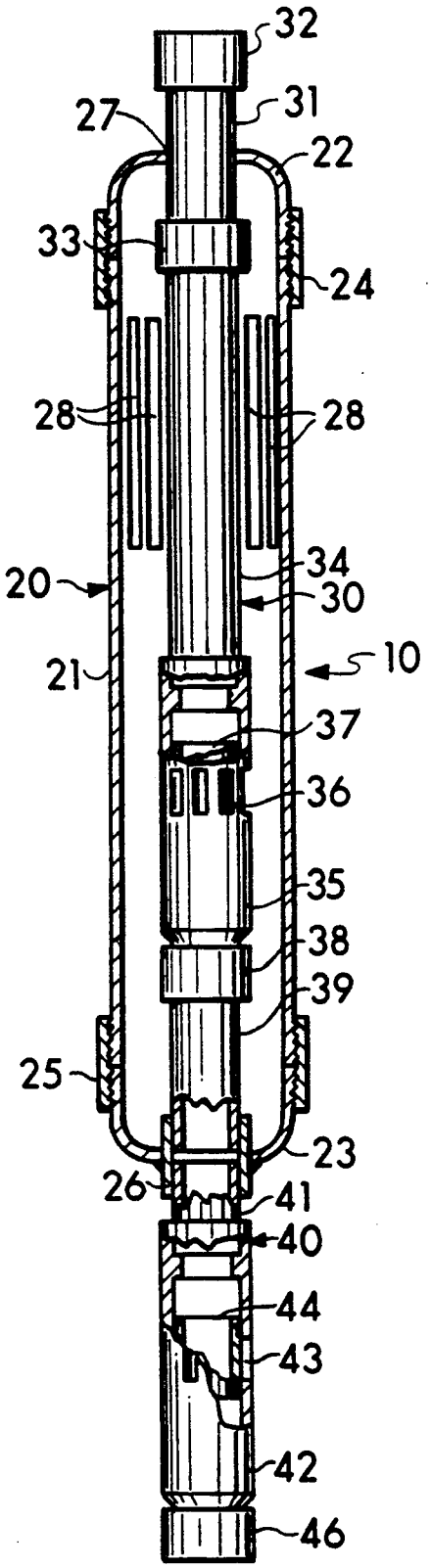
FIG. 1 is a partially cut-away, partially sectional view of the apparatus of the present invention as fully assembled.

Referring to FIG. 1, the injection/production apparatus of the present invention is illustrated generally as 10 and is comprised of an outer generally tubular assembly 20, an inner generally tubular assembly 30 and a lower generally tubular assembly 40 which are secured together as hereinafter described. The outer tubular assembly comprises a tube 21 having an upper cap 22 releasably secured to one end thereof and a lower cap 23 releasably secured to the other end thereof. Upper and lower caps 22 and 23 can be releasably secured to the ends of tube 21 by any suitable means such as, threaded collars 24 and 25, respectively. Caps 22 and 23 are preferably constructed from commercially available bull plugs which are utilized in the oil tool industry. Both the upper and lower caps are provided with an aperture or opening. A generally annular collar 26 is positioned within the aperture in cap 23 and is fixedly secured and sealed to cap 23 by any suitable means, such as, by welds. Aperture or opening 27 through the upper cap 22 and the inner diameter of collar 26 secured to lower cap 23 are sized to receive inner tubular assembly 30. A plurality of circumferentially extending slots 28 are provided in tube 21 for purposes hereinafter described. Preferably, slots 28 possess a combined area approximately equal to twice the cross sectional area of tube 21. As illustrated, slots 28 are preferably longitudinally oriented and are uniformly spaced about the circumference of tube 21.

Inner generally tubular assembly, illustrated generally as 30, is partially comprised of joints of tubing 31, 34, and 39. Tubing joint 39 has a lower end thereof positioned within and secured to collar 26 by any suitable means, such as by mated screw threads. The other end of generally tubular assembly 30 is defined by a joint of tubing 31 which extends freely through aperture 27 in upper cap 22 of outer assembly 20. The upper end of tubing joint 31 is mated with a threaded tubing collar 32 which may then be releasably secured to a tubing string positioned within the well and extending to the surface of the earth in a manner as will be evident to the skilled artisan. The tubing joints 31, 34 and 39 are releasably secured together by means of threaded collars 33 and 38. The lower end of tubing joint 34 is provided with a sliding sleeve assembly 35, for example, a model "L" sliding sleeve manufactured by Baker Oil Tools, Inc. Sliding sleeve assembly 35 is provided with a plurality of circumferentially extending slots or perforations 36 and an inner sleeve 37. Inner sleeve 37 may be manipulated by means of a wire line tool in a manner as hereinafter described to selectively close and open slots or performations 36 to permit communication between the interior and exterior of sliding sleeve assembly 35.

Lower generally tubular assembly 40 is comprised of a tubing joint 41 having the upper end thereof positioned within collar 26 and secured therein by any suitable means, such as by mated screw threads. The lower end of tubing joint 41 is releasably secured to a sliding sleeve assembly 42 which is similar in construction and size to sliding sleeve assembly 35. Accordingly, sliding sleeve assembly 42 is provided with a plurality of circumferentially extending slots or perforations 43 and an inner sleeve 44 which may also be manipulated by means of a wire line lowered through the interior of the tubing string and tubing joints 31, 34, 39 and 41 to selectively close and/or open perforations or slots 43 so as to permit fluid communication between the interior and exterior of sliding sleeve assembly 42. The external diameter of inner sleeves 37 and 44 are provided with at least two circumferentially extending elastomeric O-rings so as to provide the sealing function described above.

Figure 2:
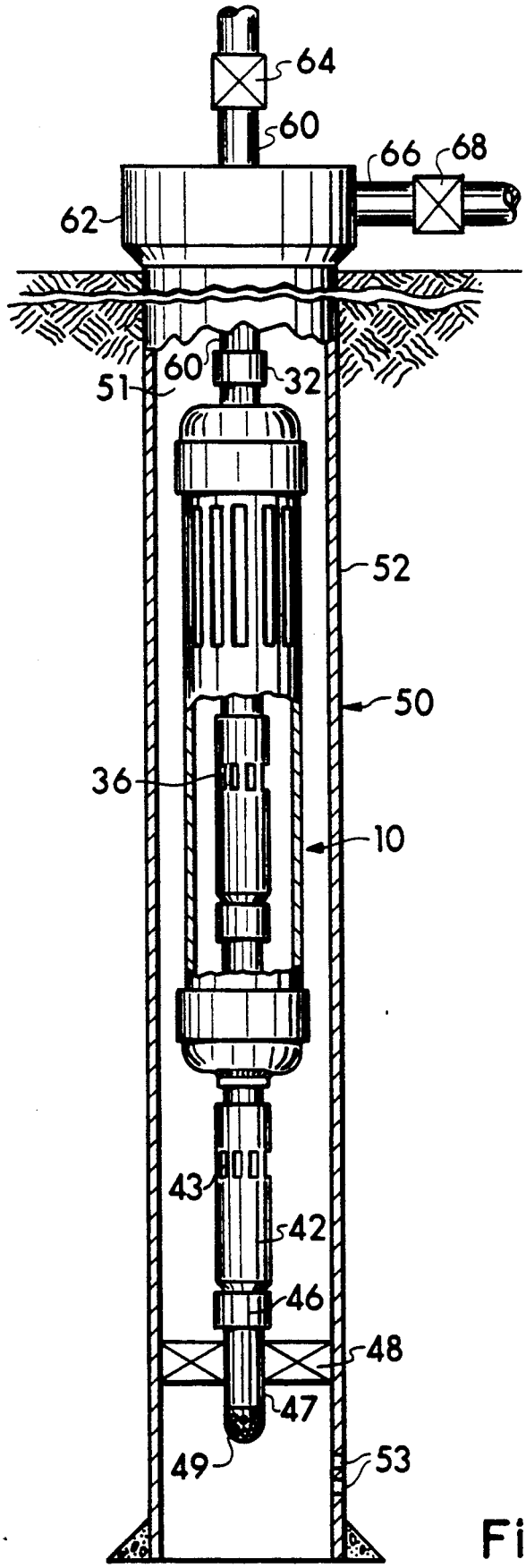
FIG. 2 is a partially cut-away perspective view of the apparatus of the present invention as assembled to a tubing string and positioned within a cased well.

The component parts of the injection and production apparatus of the present invention can be transported to a well site and readily assembled in the field prior to introduction into a well. A well illustrated generally as 50 in FIG. 2 comprises a well bore 51 having a generally tubular casing 52 secured to the walls thereof by any suitable means, such as cement, as will be evident to the skilled artisan. An interval of casing 52 which is juxtaposed to a subterranean formation of interest is provided with a plurality of perforations 53 to establish fluid communication between the well bore 51 and the subterranean formation of interest. As further illustrated in FIG. 2 prior to introduction of the apparatus 10 of the present invention into well bore 51, a tailpipe 47 is mated with collar 46 on the lower end of sliding sleeve assembly 42 by any suitable means, such as. by screw threads. Tailpipe 47 is provided with an expandable packer 48 and a perforated nipple 49 to permit entry of fluids into tailpipe 47 as hereinafter described in detail. A conventional tubing string 60 is releasably secured to the upper end of assembly 10 by coupling the end of tubing string 60 to collar 32, such as, by screw threads. Tubing string 60 extends through well head 62 at the surface of the earth and extends through a tubing master valve 64. Well head 62 is further provided with a flow line 66 which communicates with the annulus between tubing string 60 and casing 52. Flow line 66 is equipped with a valve 68 to control flow of fluids therethrough. Apparatus 10 is suspended from tubing string 60 and lowered into the well until perforated nipple 49 is adjacent perforations 53 in casing 51. Thereafter, mechanical packer 48 is expanded into contact with casing 51 as will be evident to the skill artisan.

Figure 3:
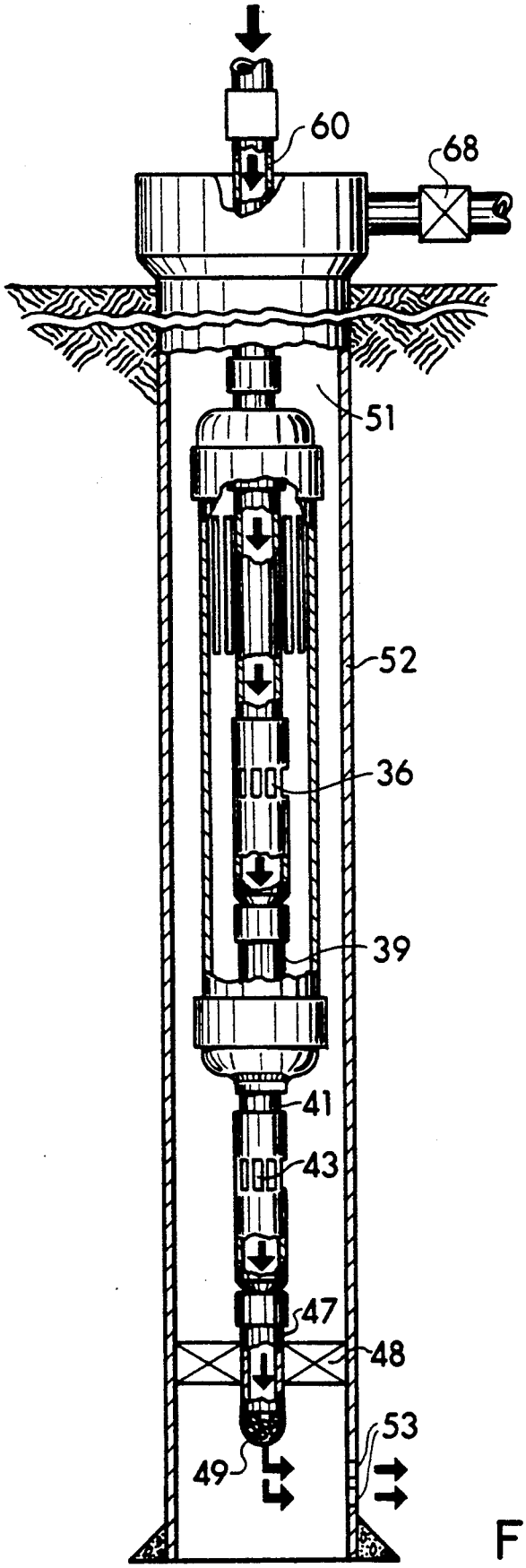
FIG. 3 is a partially cut-away perspective view of the apparatus of the present invention as assembled to a tubing string and positioned within a cased well depicting fluid injection into a subterranean formation via the apparatus of the present invention.

As the injection and production apparatus of the present invention is positioned within well bore 51, the sleeves of both sliding sleeve assemblies 35 and 42 sealingly cover slots or perforations 36 and 43, respectively, thereby preventing fluid communication between the interior and exterior of the sliding sleeve assemblies. Accordingly, as illustrated in FIG. 3, a treatment fluid is injected via tubing string 60 and the interior of inner assembly 30 and lower assembly 40. The injected fluid enters well bore 51 through perforated nipple 49 and flows through perforations 53 in casing 52 and into the subterranean formation to be treated. Thereafter, the well may be shut in by closing valves 64 and 68 for a suitable period of time to permit the injected treating fluid to reside within the subterranean formation.

Figure 4:
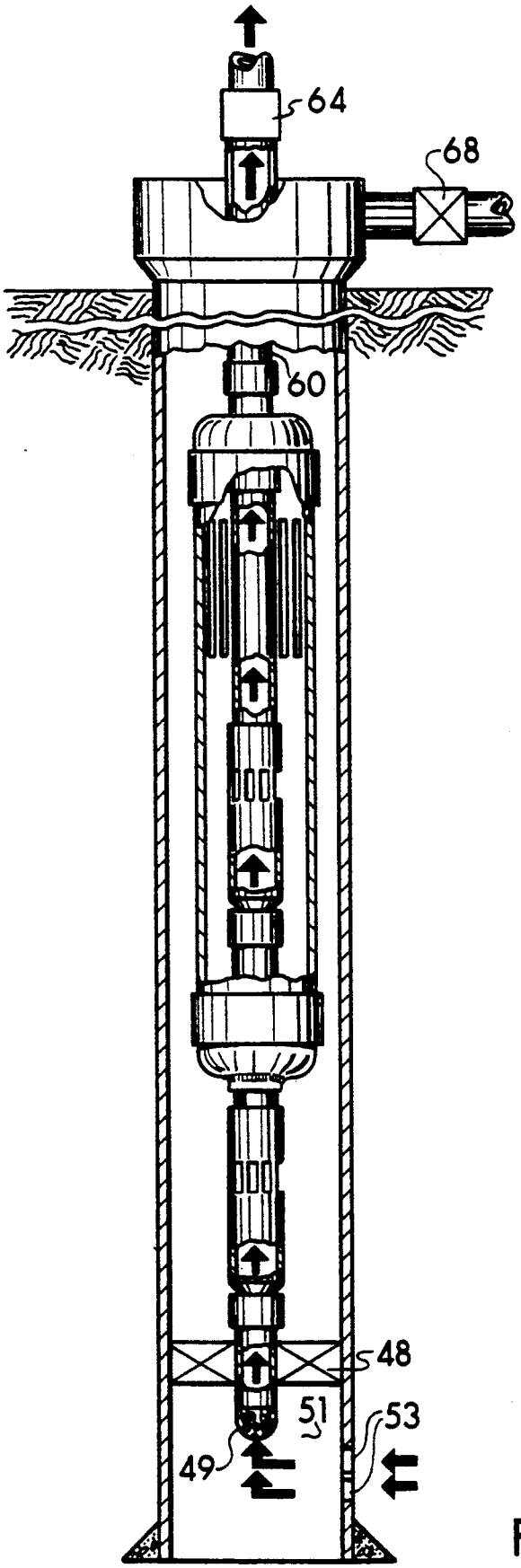
FIG. 4 is a partially cut-away perspective view of the apparatus of the present invention as assembled to a tubing string and positioned within a cased well depicting fluid production from a subterranean formation via the apparatus of the present invention.

After shut in, the well is returned to production by opening valve 64. As illustrated in FIG. 4, the pressure of gas in the treatment fluid and/or formation gas causes the fluids present in the formation to flow through perforations 53 into well bore 51 and through perforated nipple 49. Since the sliding sleeves of the sliding sleeve assemblies are still in a position blocking slots or perforations 36 and 43, the formation fluids are produced through the apparatus 10 of the present invention in a manner as illustrated and as described above with respect to injection of fluids therethrough and through tubing string 60 to the surface of the earth for further processing at a conventional production station.

When the formation pressure which was increased as a result of the injection of the treatment fluid subsides to a degree which is insufficient to produce fluids to the well head, i.e., the well dies, an artificial lift in the form of a pump must be utilized to produce further fluids from the formation. In accordance with the method of the present invention, a wireline tool is inserted via tubing string 60 and through the interior of apparatus 10 of the present invention to slide sleeve 44 present in sliding sleeve assembly 42 upwardly so as to uncover slots or perforations 43, respectively. Thereafter, a blanking or tubing plug 70 is lowered through tubing string 60 by a suitable wire line tool as will be evident to the skilled artisan. Blanking plug 70 is jarred by the wire line tool through the sliding sleeve profile present in sliding sleeve assembly 35 and is lowered into the sliding sleeve profile present in sliding sleeve assembly 42. As thus positioned within the sliding sleeve profile, plug 70 prevents axial fluid flow through sliding sleeve assembly 42. A wireline tool is again inserted through tubing string 60 and through the interior of apparatus 10 to slide sleeve 37 upwardly so as to uncover slots or perforations 36 in sliding sleeve assembly 35.

Figure 5:
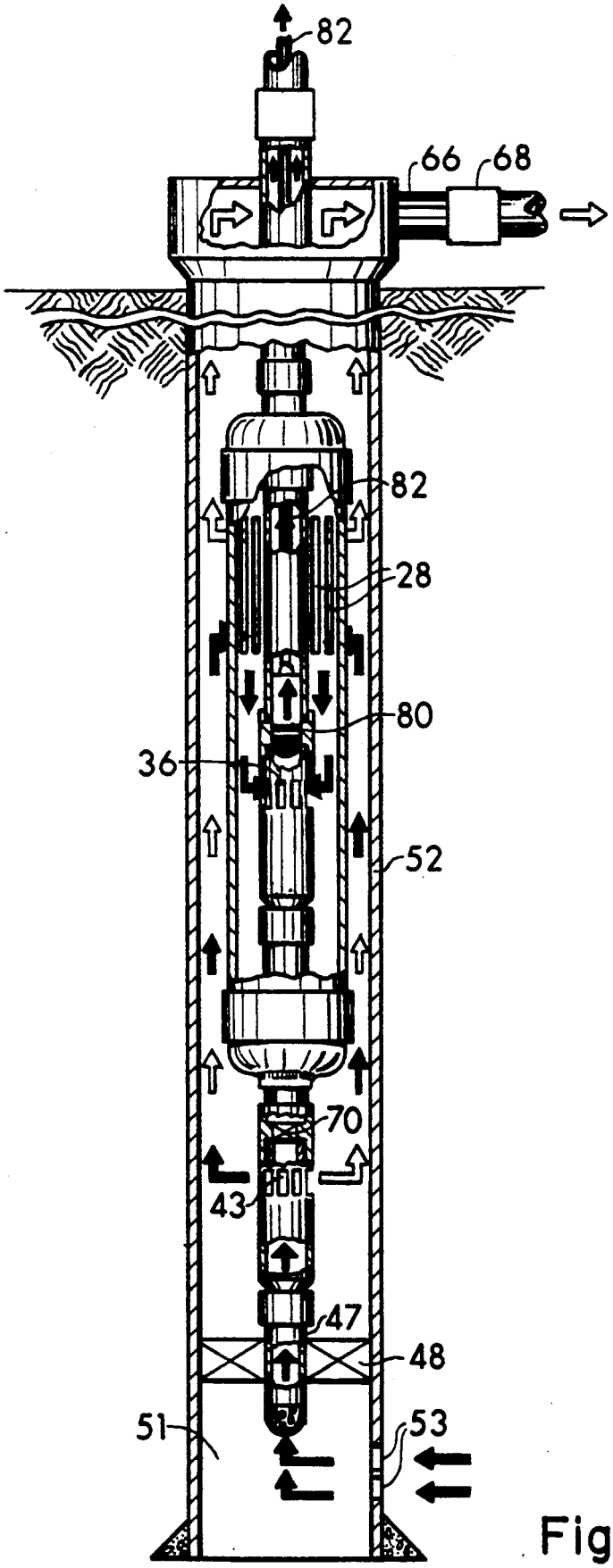
FIG. 5 is a partially cut-away perspective view of the apparatus of the present invention as assembled to a tubing string and positioned within a cased well depicting fluid production, including production of entrained or dissolved gases from a subterranean formation via the apparatus of the present invention.

An insert pump 80, for example, $2\frac{1}{2}'' \times 2'' \times 20'$ insert pump with a soft packed plunger manufactured by National Supply Company, is lowered through tubing string 60 via a sucker rod string 82 and is landed in the profile in the upper sliding sleeve assembly 35. As illustrated in FIG. 5, the insert pump is then connected to a pumping unit located at the surface, such as, a conventional horsehead reciprocating pumping unit, by means of sucker rod string 82. The surface pumping unit is then activated and during the pump cycle, fluids are produced from the formation into well bore 51. These produced fluids include treatment gas previously injected into the formation and/or formation gas. The substantial portion of the gas produced with fluids will enter via perforations 53 into well bore 51 as entrained or dissolved within the produced fluid. The fluids are pumped through perforated nipple 49 and tubing joint 47 into lower sliding sleeve assembly 42. Plug 70 causes fluids within sliding sleeve assembly 42 to be diverted through slots or perforations 43 and into the annulus between the apparatus 10 of the present invention and the casing 52. Packer 48 seals the annulus between tubing joint 47 and casing 52 thereby preventing produced fluids from flowing downwardly within the annulus past packer 48. As these fluids are diverted through slots or perforations 43 into the annulus, the concomitant pressure drop causes gas entrained or solubilized in the liquids to break out of solution. Thus, as gas and liquid travel upwardly in the annulus between the apparatus 10 and casing 52, gas will travel within this annulus to well head 62 and be produced at the surface via flow line 66 and valve 68 for further transportation and processing. Liquid flowing upwardly in the annulus will enter slots 28 in tube 21 of the outer tubular assembly 20 and flow through slots or perforations 36 of upper sliding sleeve assembly 35. Plug 70 will cause the fluid level within apparatus 10 to rise and be produced by insert pump 80 through tubing string 60 and to the surface for further transportation and processing.

The following example demonstrates the practice and utility of the present invention but is not to be construed as limiting the scope thereof.

EXAMPLE

An injection and production apparatus is constructed in accordance with the present invention. The outer tubular assembly is constructed from an approximately 40 ft long joint of 5½ in. outer diameter casing. Each end of the casing is provided with screw threads which are mated with 5½ in. casing collars. A 5½ in. bull plug having an aperture machined therethrough to accept a 2⅞ in. collar as hereinafter described is mated with one such casing collar. The other casing collar is mated with a 5½ in. bull plug having a 3.75 in. diameter hole machined into the end thereof. A 2⅞ in. internally threaded tubing collar is welded into place within the appropriate bull plug such that the 5½ in. outer diameter casing is concentrically located about the 2⅞ in. tubing collar. The casing is then slotted or perforated near the upper end thereof below the casing collar and the bull plug having the 3.75 in. diameter hole machined therethrough. The combined area of the slots is approximately twice the cross sectional area of the 5½ in. outer diameter casing. A Baker Model "L" sliding sleeve is mated with an approximately 3 ft long, 2⅞ in. outer diameter tubing sub. The other end of the sliding sleeve is attached to an approximately 31 ft long joint of 2⅞ in. outer diameter tubing which in turn is secured to an approximately 6 ft long, 2⅞ in. outer diameter tubing sub by means of a 2⅞ in. tubing collar. This inner tubular assembly is inserted through the 3.75 in. diameter hole machined into the end of one bull plug and is threadably secured to the 2⅞ in. tubing collar which is welded to the other bull plug of the outer tubular assembly. An approximately 10 ft long, 2⅞ in. outer diameter tubing sub is screwed into the bottom of the 2⅞ in. collar of the outer tubular assembly and a Baker Model "L" sliding sleeve is secured to this tubing sub. As thus constructed, the apparatus of the present invention is ready to be assembled to an appropriate tailpipe with accompanying packer and also to a suitable tubing string for entry into a well to be treated in accordance with the process of the present invention.

Alternative to the manner of assembly set forth in the Example, the bull plug having a 3.75 in. diameter hole may be mated with the other casing collar of the outer tubular assembly after the inner tubular assembly is secured to the 2⅞ in. tubing collar which is welded to the other bull plug of the outer tubular assembly.

The injection and production apparatus 10 of the present invention eliminates the need to remove an injection tubing from a well and run in a separate tubing string for producing fluid from the well. Accordingly, use of the apparatus of the present invention eliminates the need for a kill fluid. Further, tagging bottom to unseat a stuck traveling valve and the attendant damage caused to a downhole pump is also eliminated by the apparatus and process of the present invention.

The apparatus and process of the present invention can be applied in conjunction with the injection of any fluid into a subterranean formation where fluid is injected into and produced from the formation via the same well and where fluid produced from the formation includes gas. The apparatus and process of the present invention are preferably employed in conjunction with a cyclic gas injection/production process, such as a cyclic $CO_2$ injection/production process.

While the foregoing preferred embodiments of the inventions have been described and shown, it is understood that the alternatives and modifications, such as those suggested and others, may be made thereto and fall within the scope of the invention.

We claim:

1. An apparatus for transporting fluid comprising:

a first generally tubular assembly having a first end and a second end, said first assembly having at least one aperture therethrough;

a second generally tubular assembly having a first end and a second end and being positioned within said first tubular assembly, said second end of said first assembly being secured to said second end of said second assembly;

a first means for selectively permitting fluid flow between the exterior and the interior of said second assembly;

a third generally tubular assembly having a first end and a second end, said first end of said third assembly being secured to said second end of said first assembly; and a second means for selectively permitting fluid flow between the exterior and the interior of said third assembly.

2. The apparatus of claim 1 wherein said first end of said second assembly is outside of said first assembly.

3. The apparatus of claim 1 wherein said at least one aperture is a plurality of slots.

4. The apparatus of claim 3 wherein said slots extend longitudinally.

5. The apparatus of claim 4 wherein said slots are uniformly spaced about the circumference of said first assembly.

6. The apparatus of claim 1 wherein said first assembly comprises a tube defining a first and a second end, a first cap having an aperture therethrough and secured to said first end, a second cap having an aperture therethrough and secured to said second end, and a collar position within said aperture in said second cap and secured to said second cap.

7. The apparatus of claim 1 wherein said second tubular assembly has at least one performation therethrough.

8. The apparatus of claim 7 wherein said first means is a sleeve which is adapted to be selectively moved from a position covering and sealing said at least one perforation so as to permit flow of fluid therethrough.

9. The apparatus of claim 1 wherein said third tubular assembly has at least one perforation therethrough.

10. The apparatus of claim 9 wherein said second means is a sleeve which is adapted to be selectively moved from a position covering and sealing said at least one perforation so as to permit fluid flow therethrough.

11. An apparatus for injecting fluid into and producing fluid from a subterranean formation via a well in fluid communication with the formation, the apparatus comprising:

a tubing string extending from a well head at an earthen surface into said well and terminating in a first end;

a fluid transporting apparatus positioned within the well and secured to the first end of said tubing string, said apparatus comprising a first generally tubular assembly having a first end and a second end, said first assembly having at least one aperture therethrough, a second generally tubular assembly having a first end and a second end and being positioned within said first assembly, said second end of said first assembly being secured to second end of said second assembly, a first means for selectively permitting fluid flow between the exterior and the interior of said second assembly, a third generally tubular assembly having a first end and a second end, said first end of said third assembly being secured to said second end of said first assembly, and a second means for selectively permitting fluid flow between the exterior and interior of said third assembly; and a means for sealing the annulus defined between said fluid transporting apparatus and said well.

12. The apparatus of claim 11 wherein said sealing means comprises a tailpipe secured to said third tubular assembly and an elastomeric element secured to said tailpipe which is expanded into contact with the walls of said well.

13. The apparatus of claim 11 wherein said first end of said second assembly is outside of said first assembly.

14. The apparatus of claim 11 wherein said at least one aperture is a plurality of slots.

15. The apparatus of claim 14 wherein said slots extend longitudinally.

16. The apparatus of claim 15 wherein said slots are uniformly spaced about the circumference of said first assembly.

17. The apparatus of claim 11 wherein said first assembly comprises a tube defining a first and a second end, a first cap having an aperture therethrough and secured to said first end, a second cap having an aperture therethrough and secured to said second end, and a collar position within said aperture in said second cap and secured to said second cap.

18. The apparatus of claim 11 wherein said second tubular assembly has at least one perforation therethrough.

19. The apparatus of claim 18 wherein said first means is a sleeve which is adapted to be selectively moved from a position covering and sealing said at least one perforation so as to permit flow of fluid therethrough.

20. The apparatus of claim 11 wherein said third tubular assembly has at least one perforation therethrough.

21. The apparatus of claim 20 wherein said second means is a sleeve which is adapted to be selectively moved from a position covering and sealing said at least one perforation so as to permit fluid flow therethrough.

22. A method of injecting fluid into and producing fluid from a subterranean formation via a well in fluid communication with the formation comprising:

injecting fluid from an earthen surface through a first generally tubular conduit positioned within the well and into the formation;

producing fluid from the formation into the well and through the first generally tubular conduit to the surface until said fluid ceases to flow;

thereafter pumping fluid from the formation and into the tubular conduit;

diverting pumped fluid from the tubular conduit into an annulus defined between the tubular conduit and said well, said step of diverting creating a pressure drop sufficient to permit said fluid to separate into gas and liquid;

producing said gas to the surface via said annulus;

diverting said liquid into said tubular member; and producing said liquid to the surface via said tubular member.

23. The method of claim 22 wherein an elastomeric plug is inserted into said tubular member and is positioned intermediate the length thereof so as to seal said tubular member against fluid flow and divert pumped fluid into said annulus.

* * * * *